US005979463A

United States Patent [19]

Santy, III et al.

[11] Patent Number: 5,979,463

[45] Date of Patent: Nov. 9, 1999

[54] HAIR STYLING BRUSH

[75] Inventors: Joseph F. Santy, III, Yardly; S. Norton Levin, Tellford, both of Pa.

[73] Assignee: Cyber Hair Innovations, Yardly, Pa.

[21] Appl. No.: 09/266,128

[22] Filed: Mar. 10, 1999

[51] Int. Cl.[6] ..... A45D 24/16

[52] U.S. Cl. ..... 132/120; 132/139

[58] Field of Search ..... 132/120, 121, 132/123, 122, 139, 148, 227, 228, 262, 272

[56] References Cited

U.S. PATENT DOCUMENTS

| | | | |
|---|---|---|---|
| D. 249,401 | 9/1978 | Glasberg | D4/31 |
| D. 281,728 | 12/1985 | Sherman | D28/35 |
| D. 339,210 | 9/1993 | Classen | D28/15 |
| 1,672,469 | 6/1928 | Oshman et al. | 132/121 |
| 2,473,227 | 6/1949 | Solomon | 132/85 |
| 2,507,373 | 5/1950 | Finkelstein | 132/120 |
| 3,491,777 | 1/1970 | Grosbard | 132/120 |
| 4,032,747 | 6/1977 | Kunz | 219/222 |
| 4,932,425 | 6/1990 | Chen | 132/120 |
| 5,052,070 | 10/1991 | Klugmann | 15/159 A |
| 5,887,600 | 3/1999 | Wilk | 132/262 |

*Primary Examiner*—Todd E. Manahan

*Attorney, Agent, or Firm*—Harness, Dickey & Pierce, P.L.C.

[57] ABSTRACT

A brush for hair styling includes a handle portion and a head portion. The head portion extends from the handle portion. The head portion defines a longitudinally extending channel and a plurality of openings. A first row of substantially rigid teeth are longitudinally disposed along the head portion. A second row of substantially rigid teeth are longitudinally disposed along the head portion. The second row of substantially rigid teeth radially extend in an opposite direction to the first row of substantially rigid teeth. A bristled element is disposed within the channel and includes a plurality of flexible brush bristles extending through the openings in the head portion. The first and second rows of substantially rigid teeth radially extend substantially beyond the plurality of flexible brush bristles.

16 Claims, 3 Drawing Sheets

HAIR STYLING BRUSH

BACKGROUND OF THE INVENTION

1. Technical Field

The present invention generally pertains to hair styling. More particular, the present invention pertains to a brush for styling hair. More specifically, but without restriction to the particular embodiment and/or use which is shown and described for purposes of illustration, the present invention relates to a brush for styling hair which incorporates a pair of rows of teeth extending in opposing directions.

2. Discussion

Hair styling is an art which frequently requires various implements and environmental conditions to produce desired results. The implements assume many configurations, such as combs, brushes, curlers, and others. Frequently, in order to increase the effectiveness of such implements, it is necessary to utilize the implements in combination with heat from a source such as a blow dryer. Known implements for styling hair have proven to be successful for certain desired results. However, there remains a need in the art to provide a hair styling brush which may be used along with a blow dryer, for example, to create more lift and volume for the hair. Additionally, a need remains in the art for an improved brush design which can be effectively used with hair of various lengths.

SUMMARY OF THE INVENTION

It is a general object of the present invention to provide an improved brush for the styling of hair.

It is another object of the present invention to provide a hair styling brush which may be used to create more lift and volume for the hair.

It is another object of the present invention to provide a hair styling brush including a plurality of rigid teeth and a plurality of flexible bristles.

It is a more particular object of the present invention to provide a hair styling brush having a pair of rows of rigid teeth which extend in opposing directions.

In one form, the present invention provides a brush for hair styling. The brush includes a handle portion and a head portion extending from the handle portion. The head portion defines a longitudinally extending channel and a plurality of openings. A first row of substantially rigid teeth are longitudinally disposed along the head portion. A second row of substantially rigid teeth are longitudinally disposed along the head portion. The second row of substantially rigid teeth radially extend in an opposite direction to the first row of substantially rigid teeth. A bristled element is disposed within the channel and includes a plurality of flexible brush bristles extending through the openings in the head portion. The first and second rows of substantially rigid teeth radially extend substantially beyond the plurality of flexible brush bristles.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
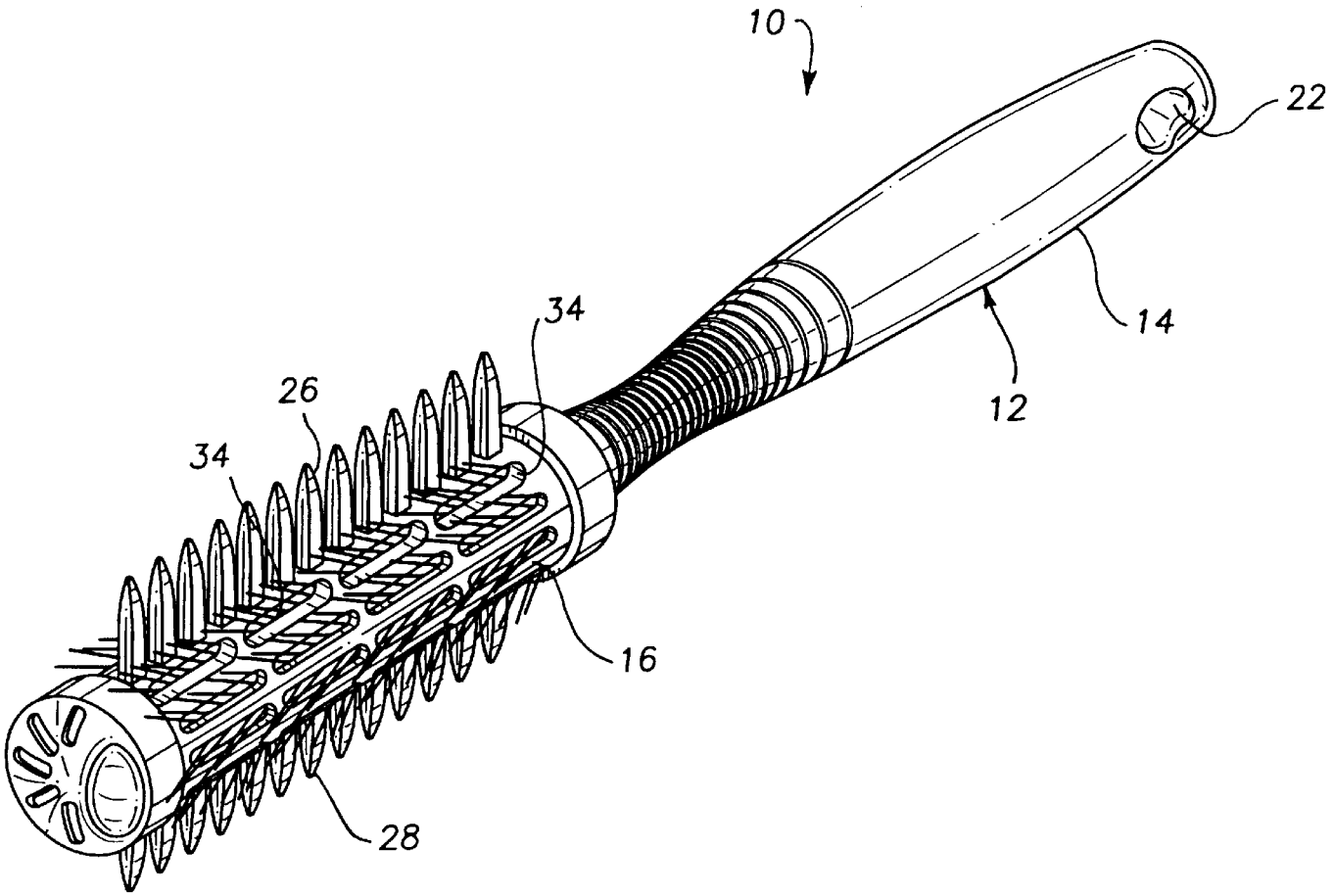
FIG. 1 is a perspective view of a brush for styling hair constructed in accordance with the teachings of a preferred embodiment of the present invention.
Figure 2:
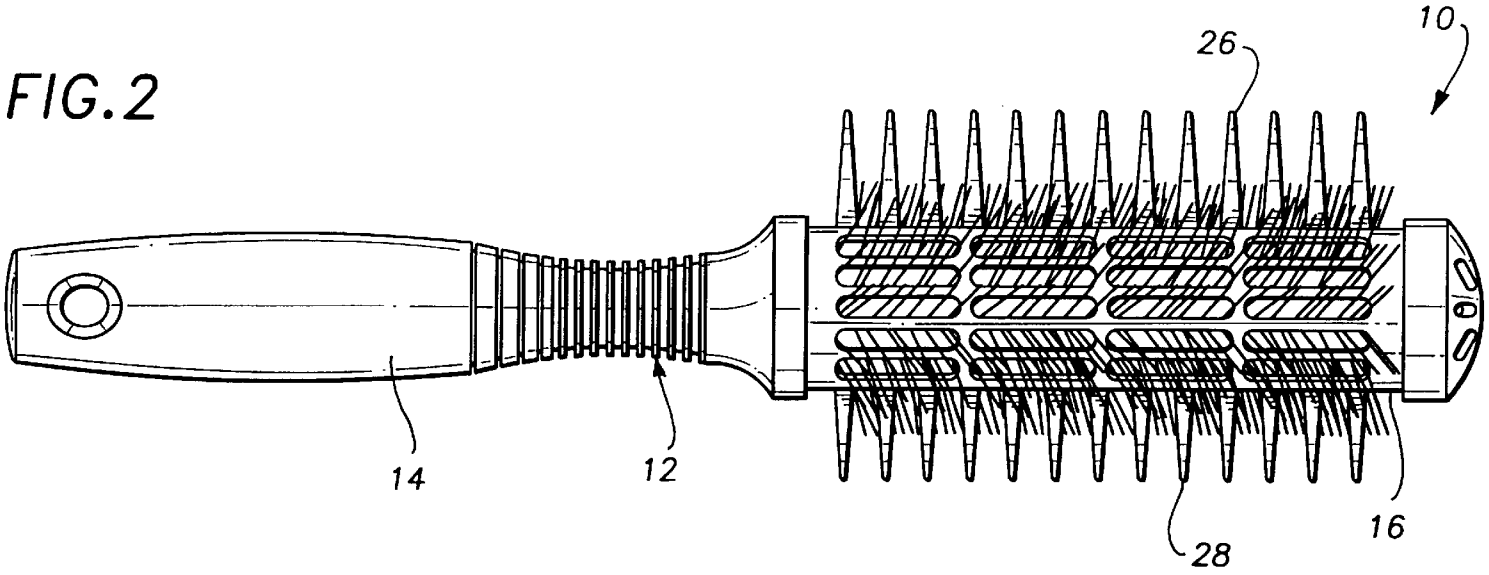
FIG. 2 is a side view of the brush for styling hair of the present invention.
Figure 3:
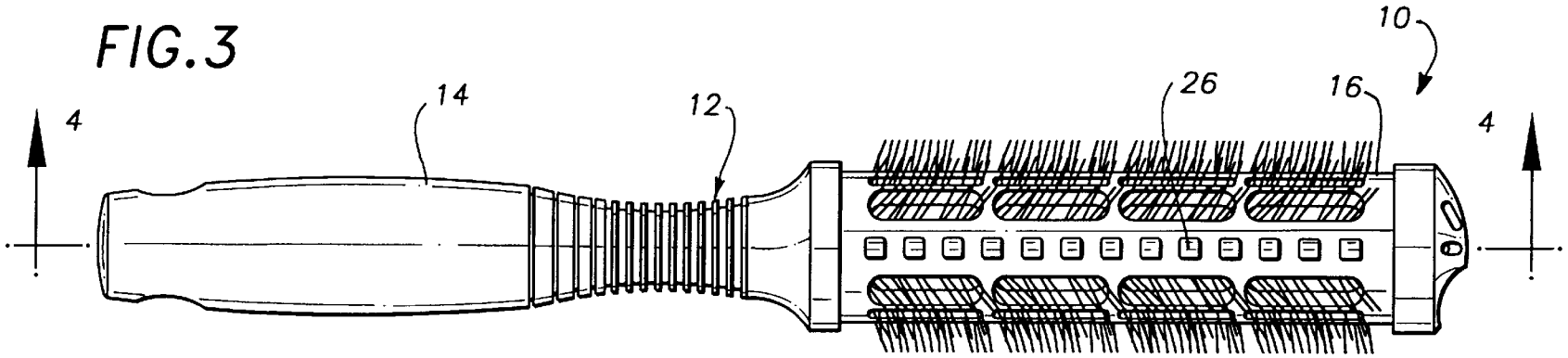
FIG. 3 is another side view of the brush for styling hair of the present invention.
Figure 4:
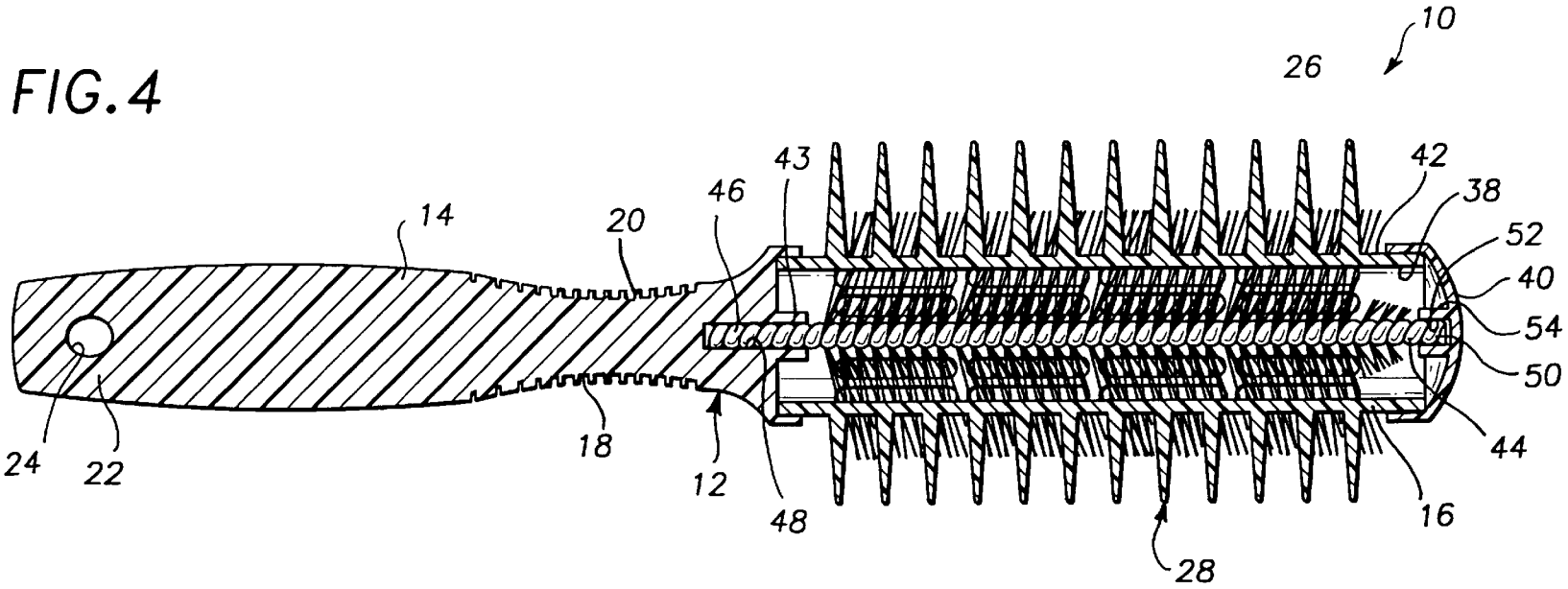
FIG. 4 is a cross-sectional view taken along the line 4—4 of FIG. 3.

With general reference to the drawings a brush for styling hair constructed in accordance with the teachings of the preferred embodiment of the present invention is identified at reference numeral 10. It will be understood that the drawings represent merely an exemplary embodiment incorporating the teachings of the present invention.

With initial reference to FIGS. 1 through 4, the brush 10 of the present invention is illustrated to generally include a main body 12 having a handle portion 14 and a head portion 16. The main body 12 is preferably constructed of plastic or other suitable material. In the embodiment illustrated, the main body 12 is unitarily constructed.

The handle portion 14 is generally cylindrical in shape and is ergonomically constructed to include a reduced diameter portion 18. The reduced diameter portion 18 is formed to include a plurality of circumferentially extending grooves 20. A distal end 22 of the handle portion 14 includes an aperture 24 from which the brush 10 can be hung from a peg (not shown) or the like.

The head portion 16 of the brush 10 is also generally cylindrical in shape. The head portion 16 is unitarily formed to include first and second rows or pluralities of teeth 26 and 28. In the embodiment illustrated, the first and second rows of teeth 26 and 28 are substantially identical. As the first and second rows of teeth 26 and 28 are unitarily constructed with the head portion 16, they are formed from plastic or other suitable material. It will be appreciated in this regard that the first and second pluralities of teeth 26 and 28 are substantially rigid. While not shown, it will be further understood that the first and second rows of teeth 26 and 28 may alternatively be formed independently from the head portion 16 and attached thereto in any manner well known in the art.

Figure 5:
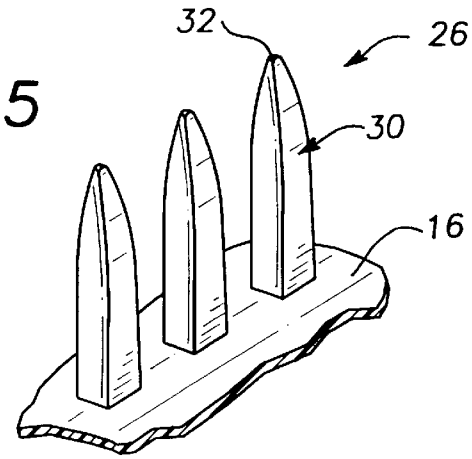
FIG. 5 is an enlarged side view of one of the rigid prongs of the brush for styling hair of the present invention.

With continued reference to FIGS. 1 through 4 and additional reference to FIG. 5, the teeth 30 of the first and second pluralities of teeth 26 and 28 are all identical in shape. In this regard, the teeth 30 are generally triangular in side view, terminating at a point 32. In a similar manner, the teeth are generally triangular in end view, terminating in the point 32. In the exemplary embodiment, the first and second rows of teeth 26 and 28 extend in opposing directions and are equally spaced along the length of the head portion 16. Further in the exemplary embodiment, the teeth 30 of the first row of teeth 26 are radially longer than the teeth 30 of the second row of teeth 28. The difference in radially length provides flexibility for the styling of different types and lengths of hair.

The head portion 16 of the brush 10 of the present invention is further shown to include a plurality of elongated slots 34. On each side of the brush 10 between the rows of teeth 26 and 28, the head portion 16 defines twenty oval shaped slots 34. The slots are arranged in four rows extending along the length of the brush and five columns which extend in a circumferential direction. The oval slots 34 permit flexible brush bristles 36 of a bristled element 38 to extend therethrough. This aspect of the present invention will be described further below.

The head portion 16 of the brush 10 defines a cylindrical cavity or channel 38 along its length. Access to the cylindrical cavity 38 is provided through a cap 40 which is removably attached to a distal end 42 of the head portion 16. The cap 40 is maintained in the preferred embodiment in a friction fit. The cap 40 is formed to include a plurality of holes.

Figure 6:
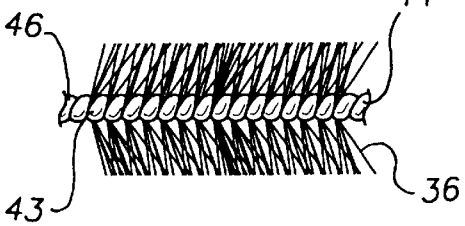
FIG. 6 is a side view of a bristle assembly of the present invention shown removed from the brush for purposes of illustration.

With particular reference to FIG. 6, the bristled element 38 of the brush 10 of the present invention is constructed in a conventional manner to include an elongated member 43 having a pair of metal wires or rods 44. The rods 44 are coiled in an elongated fashion and capture a plurality of flexible brush bristles 36. As noted above, the flexible brush bristles 36 extend through the oval slots 34 of the head portion 16. In the preferred embodiment, the rigid teeth 30 of the first and second rows of teeth 26 and 28 radially extend significantly beyond the flexible brush bristles 36.

A first end 46 of the elongated member 43 is disposed within an aperture 48 which extends into the handle portion 14 of the brush 10. A second end 50 of the elongated member 43 is captured in an aperture 52 provided in a boss portion 54 carried by the cap 40. By removing the cap 42, the bristled element can easily be removed from the brush 10 to facilitate the removal of hair therefrom or other cleaning or replacement.

In use, the brush 10 of the present invention can be used for various applications. In one exemplary use, the brush 10 can be used for styling with a blow dryer (not shown) to add lift and volume to the hair. Since the rigid teeth 30 of the first and second rows of teeth 26 and 28 radially extend beyond the flexible brush bristles 36, the rigid teeth 30 can more easily grasp the hair for uplifting thereof. In addition, the rigid teeth 30 of the first and second rows of teeth 26 and 28 function as a comb directing hair. Furthermore, the rigid teeth 30 of the first and second rows of teeth 26 and 28 function as a detangler.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A brush for hair styling comprising:

a handle portion;

a head portion extending from said handle portion, said head portion defining a longitudinally extending channel and a plurality of openings;

a first row of substantially rigid teeth longitudinally disposed along said head portion;

a second row of substantially rigid teeth longitudinally disposed along said head portion, said second row of substantially rigid teeth radially extending in an opposite direction to said first row of substantially rigid teeth; and a bristled element disposed within said channel and including a plurality of flexible brush bristles extending through said openings in said head portion;

said first and second rows of substantially rigid teeth radially extending substantially beyond said plurality of flexible brush bristles.

2. The brush for hair styling of claim 1, further comprises a cap removably attached to said head portion to provide selective access to said cavity.

3. The brush for hair styling of claim 1, wherein said first row of teeth radially extends more than said second row of teeth.

4. The brush for hair styling of claim 1, wherein said plurality of openings are oval in shape.

5. The brush for hair styling of claim 1, wherein said bristled element is removable from said cavity.

6. The brush for hair styling of claim 1, wherein said bristled element includes an elongated member from which said bristles radially extend.

7. The brush for hair styling of claim 6, wherein said elongated member of said bristled element includes an end received within an aperture extending into said handle portion.

8. The brush for hair styling of claim 2, wherein said bristled element includes an elongated member from which said bristles radially extend and further wherein said elongated member of said bristled element includes an end received within an aperture defined by a boss portion carried by said cap.

9. A brush for hair styling comprising:

a handle portion;

a head portion extending from said handle portion, said head portion defining a longitudinally extending channel and a plurality of openings;

a first row of substantially rigid teeth longitudinally disposed along said head portion;

a second row of substantially rigid teeth longitudinally disposed along said head portion, said second row of substantially rigid teeth radially extending in an opposite direction to said first row of substantially rigid teeth; and a bristled element disposed within said channel and including a plurality of flexible brush bristles extending through said openings in said head portion;

said first and second rows of substantially rigid teeth radially extending substantially beyond said plurality of flexible brush bristles;

said first and second rows of substantially rigid teeth being integrally formed with said head portion.

10. The brush for hair styling of claim 9, further comprises a cap removably attached to said head portion to provide selective access to said cavity.

11. The brush for hair styling of claim 9, wherein said first row of teeth radially extends more than said second row of teeth.

12. The brush for hair styling of claim 9, wherein said plurality of openings are oval in shape.

13. The brush for hair styling of claim 9, wherein said bristled element is removable from said cavity.

14. The brush for hair styling of claim 9, wherein said bristled element includes an elongated member from which said bristles radially extend.

15. The brush for hair styling of claim 14, wherein said elongated member of said bristled element includes an end received within an aperture extending into said handle portion.

16. The brush for hair styling of claim 10, wherein said bristled element includes an elongated member from which said bristles radially extend and further wherein said elongated member of said bristled element includes an end received within an aperture defined by a boss portion carried by said cap.

* * * * *